United States Patent [19]

Borst

[11] Patent Number: 4,594,971

[45] Date of Patent: Jun. 17, 1986

[54] VARIABLE FUEL/OIL RATIO PUMP FOR TWO-STROKE INTERNAL COMBUSTION ENGINE

[75] Inventor: Gaylord M. Borst, Highland Park, Ill.

[73] Assignee: Outboard Marine Corporation, Waukegan, Ill.

[21] Appl. No.: 665,138

[22] Filed: Oct. 26, 1984

[51] Int. Cl.[4] ..... F01M 3/00

[52] U.S. Cl. ..... 123/73 AD; 123/DIG. 5; 417/399; 74/88

[58] Field of Search ..... 123/73 AD, DIG. 5; 417/398, 399; 74/88, 89

[56] References Cited

U.S. PATENT DOCUMENTS

| | | | |
|---|---|---|---|
| 1,377,895 | 5/1921 | Long | 417/392 |
| 2,980,032 | 4/1961 | Schneider | 417/479 |
| 3,068,961 | 12/1962 | Stihl et al. | 417/319 |
| 3,182,601 | 5/1965 | Johnson | 417/380 |
| 3,327,635 | 6/1967 | Sachnik | 417/399 |
| 4,194,483 | 3/1980 | McChesney et al. | 123/DIG. 5 |
| 4,383,504 | 5/1983 | Walsworth | 123/73 AD |
| 4,473,340 | 9/1984 | Walsworth | 123/73 AD |

FOREIGN PATENT DOCUMENTS

| | | |
|---|---|---|
| 642654 | 9/1950 | United Kingdom . |
| 1032445 | 6/1966 | United Kingdom . |
| 2093944 | 9/1982 | United Kingdom . |

*Primary Examiner*—Magdalen Y. C. Greenlief
*Attorney, Agent, or Firm*—Michael, Best & Friedrich

[57] ABSTRACT

A mechanism for pumping fluid in response to pressure pulses, the mechanism comprising a fluid pump including a reciprocating piston operable to pump fluid, a rotatable eccentric wheel including a cam surface, a linkage engageable with the cam surface for rotating the wheel in response to pressure pulses, and a linkage engageable with the cam surface for causing reciprocation of the piston in response to rotation of the wheel.

24 Claims, 1 Drawing Figure

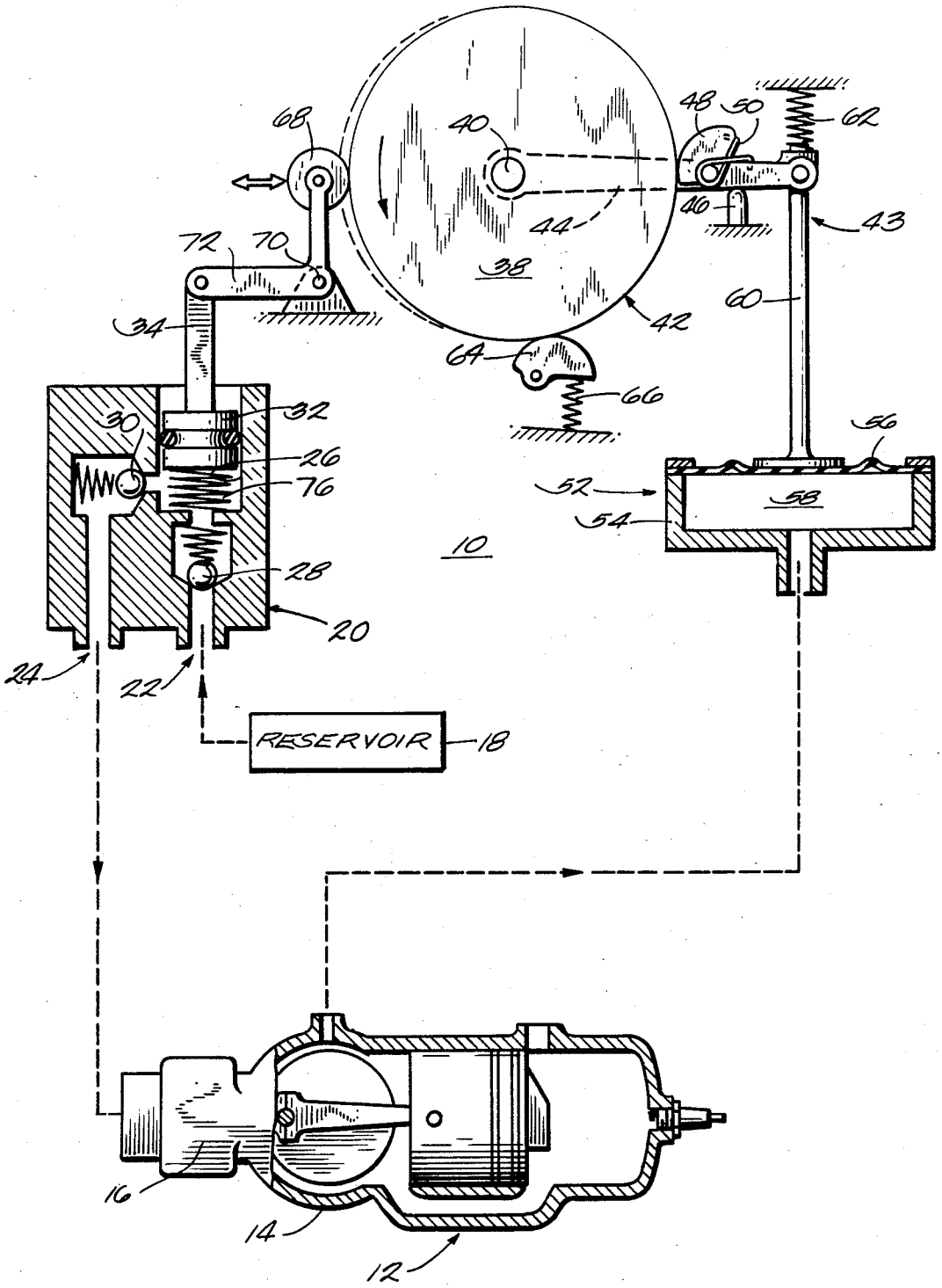
68
40
48
50
62
44
46
43
72
70
38
60
34
42
64
66
32
30
26
76
56
52
58
54
10
28
20
24
22
RESERVOIR
18
16
14
12

VARIABLE FUEL/OIL RATIO PUMP FOR TWO-STROKE INTERNAL COMBUSTION ENGINE

BACKGROUND OF THE INVENTION

The invention relates to two-stroke internal combustion engines and, more particularly, to the pumps in such engines for pumping oil to the engine.

Attention is also directed to British Pat. Nos. 1,032,445 and 642,654.

Attention is also directed to British Patent Application No. 2,093,944.

Attention is also directed to the following U.S. Patents:

Johnson U.S. Pat. No. 3,182,601, issued May 11, 1965;

Schneider U.S. Pat. No. 2,980,032, issued Apr. 18, 1961; and

Long U.S. Pat. No. 1,377,895, issued May 10, 1921.

SUMMARY OF THE INVENTION

The invention provides an engine apparatus comprising a two-cycle internal combustion engine including a crankcase that emits pressure pulses of variable amplitude and frequency, a lubricant reservoir, a pump having an inlet communicating with the reservoir and an outlet communicating with the engine, the pump including a reciprocating piston operable to pump lubricant from the reservoir to the engine at a flow rate that is a linear function of the frequency of reciprocation of the piston, a rotatable eccentric wheel including a cam surface, means engageable with the cam surface and communicating with the crankcase for rotating the wheel in response to the crankcase pressure pulses at an rpm that is a linear function of the pulse amplitude and of the pulse frequency, and means engageable with the cam surface for causing reciprocation of the piston in response to rotation of the wheel at a frequency that is a linear function of the rpm of the wheel.

In one embodiment, the wheel is rotatable about a first pivot, and the means for rotating the wheel includes a lever arm having a first end pivotally mounted on the first pivot, a pawl pivotally mounted on the lever arm and engageable with the cam surface for causing rotation of the wheel in one rotational direction in response to rotation of the lever arm in the one direction, and means for rotating the lever arm in the one direction in response to the crankcase pressure pulses.

In one embodiment, the lever arm has a second end opposite the first end, the means for rotating the lever arm includes a housing forming a recess, a moveable wall in the recess and defining a chamber in communication with said crankcase such that the wall moves in response to the crankcase pressure pulses, and a link connected between the moveable wall and the second end of the lever arm.

In one embodiment, the apparatus further comprises means for preventing rotation of the wheel in the rotational direction opposite of the one rotational direction.

In one embodiment, the means for preventing rotation of the wheel in the opposite rotational direction includes a second pivot, a pawl pivotally mounted on the second pivot and engageable with the cam surface, and means biasing the pawl into engagement with the cam surface.

In one embodiment, the means for causing reciprocation of the piston in response to rotation of the wheel includes a roller engageable with the cam surface, means biasing the roller into engagement with the cam surface, and linkage means connected between the piston and the roller for causing reciprocation of the piston in response to movement of the roller.

In one embodiment, the linkage means includes a third pivot, and a rocker arm pivotally mounted on the third pivot and having a first end pivotally connected to the piston and a second end having the roller pivotally mounted thereon.

In one embodiment, the pump includes a cylinder slidably receiving the piston and having a cylinder head, and the means biasing the roller includes a spring positioned between the piston and the cylinder head and biasing the piston away from the cylinder head.

The invention also provides a mechanism for pumping fluid in response to pressure pulses, the mechanism comprising fluid pump means including a reciprocating piston operable to pump fluid, a rotatable eccentric wheel including a cam surface. means engageable with the cam surface for rotating the wheel in response to pressure pulses, and means engageable with the cam surface for causing reciprocation of the piston in response to rotation of the wheel.

The invention also provides a mechanism for pumping fluid in response to pressure pulses having variable amplitude and frequency, the mechanism comprising fluid pump means including a reciprocating piston operable to pump fluid at a flow rate that is a linear function of the frequency of reciprocation of said piston, a rotatable eccentric wheel including a cam surface, means engageable with the cam surface for rotating the wheel in response to pressure pulses at an rpm that is a linear function of the pulse amplitude and of the pulse frequency, and means engageable with the cam surface for causing reciprocation of the piston in response to rotation of the wheel at a frequency that is a linear function of the rpm of the wheel.

Other features and advantages of the invention will become apparent to those skilled in the art upon review of the following detailed description, claims, and drawings.

DESCRIPTION OF THE DRAWINGS

FIG. 1 is a schematic view of an engine apparatus embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is an engine apparatus 10 comprising a two-stroke internal combustion engine 12 including a crankcase 14, and a carburetor 16 communicating with the crankcase 14 for providing a fuel/oil/air mixture to the crankcase 14. During operation of the engine 12, the crankcase 14 emits pressure pulses of variable amplitude and frequency, depending on the engine load and speed (rpm). While the illustrated embodiment of the invention includes a carburetor, it should be understood that alternative embodiments of the invention can include any suitable means for providing a fuel/oil/air mixture to the crankcase 14.

The apparatus 10 also comprises a lubricant or oil reservoir 18 and a pump 20 having an inlet 22 communicating (indicated by a dotted line) with the oil reservoir 18, and an outlet 24 communicating (indicated by a dotted line) with the carburetor 16. The pump outlet 24 can alternatively communicate with other engine locations where lubrication is desired. The pump 20 includes a pump chamber or cylinder 26 communicating with both the pump inlet 22 and outlet 24. A check valve 28 prevents oil flow from the pump chamber 26 to the pump inlet 22 while permitting flow from the inlet 22 to the pump chamber 26, and a check valve 30 prevents oil flow from the pump outlet 24 to the pump chamber 26 while permitting flow from the pump chamber 26 to the pump outlet 24. The pump 20 also includes a piston 32 slidably received in the pump cylinder or chamber 26 for reciprocal movement therein. A piston rod 34 is attached to the piston 32.

Movement of the piston 32 outwardly of the pump chamber 26 (upwardly in FIG. 1) creates a vacuum in the chamber 26 which causes oil to flow into the chamber 26 through the pump inlet 22. Subsequent movement of the piston 32 inwardly into the chamber 26 (downwardly in FIG. 1) forces the oil out of the pump chamber 26 through the pump outlet 24 to the carburetor 16. Thus, reciprocal movement of the piston 32 pumps oil from the reservoir 18 to the engine 12. The flow rate of the oil being pumped is a linear function of, or directly proportional to, the frequency of reciprocation of the piston 32, assuming that the length of the piston stroke is constant.

The apparatus 10 also comprises an eccentric wheel 38 mounted for rotation about a first pivot 40. The perimeter of the eccentric wheel 38 defines a cam surface 42. The apparatus 10 also comprises means 43 engageable with the cam surface 42 and communicating with the crankcase 14 for rotating the wheel 38 in response to the crankcase pressure pulses at a rpm that is a linear function of the pulse amplitude and of the pulse frequency. In other words, when the pressure pulse amplitude doubles, the rpm of the wheel 38 doubles, and when the pressure pulse frequency doubles, the rpm of the wheel 38 doubles. When the pressure pulse amplitude and frequency both double at the same time, the rpm of the wheel 38 quadruples.

While various suitable means 43 can be employed for this purpose, in the preferred embodiment, such means 43 includes a lever arm 44 having opposite first and second ends. The first end of the lever arm 44 is pivotally mounted on the first pivot 40 for rotation independent of the rotation of the wheel 38. Downward movement of the lever arm 44 is limited by a stop 46. The means 43 for rotating the wheel 38 also includes a pawl 48 pivotally mounted on the lever arm 44 intermediate the first and second ends and engageable with the cam surface 42. The pawl 48 is biased against the cam surface 42 by a spring 50. The pawl 48 is shaped such that when the lever arm 44 is moved in the counter-clockwise direction, the pawl 48 fixedly engages the cam surface 42 and causes the wheel 38 to rotate with the lever arm 44 in the counter-clockwise direction. When the lever arm 44 is rotated in the clockwise direction, the pawl 48 slides along the cam surface 42.

The means 43 for rotating the wheel 38 also includes means 52 for rotating the lever arm 44 in the counter-clockwise direction in response to the crankcase pressure pulses. While various suitable means 52 can be employed for this purpose, in the illustrated construction, such means 52 includes a housing 54 which forms a recess, and a movable wall 56 in the recess defining a chamber 58 which communicates (indicated by a dotted line) with the crankcase 14 such that the wall 56 moves in response to the crankcase pressure pulses. The means 52 also includes a link 60 having one end connected to the movable wall 56 for movement therewith, and a second end pivotally connected to the second end of the lever arm 44. A spring 62 biases the link 60 and the second end of the lever arm 44 downwardly. With each pressure pulse, the link 60 will move upwardly a distance that is a linear function of the amplitude of the pulse. After each pulse, the link 60 will move downwardly under the influence of the spring 62. Therefore, the link 60 will move upwardly with each pulse, and the frequency of the strokes of the link 60 will equal the frequency of the crankcase pressure pulses. Since each upward stroke of the link 60 causes rotation of the wheel 38 in the counter-clockwise direction, the link 60 will cause rotation of the wheel 38 at a rpm that is a linear function of both the amplitude and frequency of the crankcase pressure pulses.

The apparatus 10 also comprises means for preventing rotation of the wheel 38 in the clockwise direction. While various suitable means can be employed for this purpose, in the preferred embodiment, such means includes a pawl 64 engageable with the cam surface 42. The pawl 64 is biased against the cam surface 42 by a spring 66, and does not inhibit rotation of the wheel 38 in the counterclockwise direction.

The apparatus 10 further comprises means engageable with the cam surface 42 for causing reciprocation of the piston 32 in response to rotation of the wheel 38 at a frequency that is a linear function of, or directly proportional to, the rpm of the wheel 38.

While various suitable means can be employed for causing reciprocation of the piston 32, in the illustrated construction, such means includes a roller 68 engageable with the cam sruface 42, means biasing the roller 68 into engagement with the cam surface 42, and linkage means connected between the piston 32 and the roller 68 for causing reciprocation of the piston 32 in response to movement of the roller 68. While various suitable linkage means can be employed, in the preferred embodiment, such linkage means includes a second pivot 70, and a rocker arm 72 pivotally mounted on the second pivot 70. The rocker arm 72 is L-shaped and has a first end pivotally connected to the piston rod 34, and a second end having the roller 68 pivotally mounted thereon.

While various suitable means can be used for biasing the roller 68 into engagement with the cam surface 42, in the preferred embodiment, such means includes a spring 76 positioned between the cylinder head and the piston 32. The biasing force of the spring 76 moves the piston 32 and piston rod 34 upwardly, and this pivots the rocker arm 72 about the pivot 70, thereby biasing the roller 68 against the cam surface 42.

With each rotation of the eccentric wheel 38 about the first pivot 40, the roller 68 will move inwardly and outwardly (or right and left) relative to the first pivot 40, because of the shape of the wheel 38 and because the roller 68 is biased against the cam surface 42. Accordingly, rotation of the wheel 38 will cause reciprocal horizontal movement of the roller 68. The rocker arm 72 translates this reciprocal horizontal movement of the roller 68 into reciprocal vertical movement of the piston rod 34, and this causes reciprocal vertical movement of the piston 32, at a frequency equal to the rpm of the wheel 38. As explained above, reciprocal vertical movement of the piston 32 pumps oil from the reservoir 18 to the engine 12.

In the preferred embodiment, the piston 32 reciprocates at a frequency that is equal to the rpm of the wheel 38. In alternative embodiments, such as, for example, one in which the wheel 38 has two lobes instead of one, so that the piston 32 moves through two strokes for every rotation of the wheel 38, the frequency of reciprocation of the piston 32 need not equal the rpm of the wheel 38.

Because the shape of the wheel 38 is fixed, the length of the horizontal movement of the roller 68 is constant. Therefore, the length of the piston strokes is constant. As explained above, this means that the flow rate of the oil being pumped by the pump 20 is a linear function of the frequency of reciprocation of the piston 32. Since the frequency of reciprocation of the piston 32 is equal to the frequency of rotation of the wheel 38, and since the frequency of rotation of the wheel 38 is a linear function of the frequency of the crankcase pressure pulses, the flow rate of the fluid being pumped is a linear function of the frequency of the crankcase pressure pulses. Additionally, since the frequency of rotation of the wheel 38 is also a linear function of the amplitude of the crankcase pressure pulses, the flow rate of the fluid being pumped is also a linear function of the amplitude of the crankcase pressure pulses.

In order to allow the pumping means to respond accurately to individual crankcase pressure pulses, which can reach frequencies of 100 per second or higher (pulse frequency equals engine rpm), the masses of all of the parts of the pumping means should be minimized, the volume of the chamber 58 and the force exerted by the spring 62 should be minimized, and the flexibility of the movable wall 56 should be maximized.

Because the amplitude of the crankcase pressure pulses varies with the engine load, and because the frequency of the crankcase pressure pulses varies with the engine speed or rpm, the flow rate of the oil being pumped varies with both the engine load and speed. As engine load and speed increase, the oil flow rate increases.

With two-cycle engines, it is often desirable to have the ratio of fuel to oil vary between idle and wide open throttle (WOT) conditions. For instance, it may be desirable to have a fuel/oil ratio of 50/1 at WOT, and a fuel/oil ratio of 100/1 at idle. The pumping mechanism of the invention provides such a variable fuel/oil ratio.

Following is an example of the operation of the apparatus 10: Assume engine speed at idle is 500 rpm, and at WOT is 5,000 rpm. Assume also that with normal engine loads, the ratio of fuel consumption at WOT to fuel consumption at idle is 10/1. Furthermore, assume that the amplitude of the crankcase pressure pulses is 4 psi at idle and 8 psi at WOT, and that the movable wall 56, spring 62, and wheel 38 are such that the link 60 moves the wheel 38 through an arc of 2° for each crankcase pressure pulse at WOT.

At WOT, the wheel 38 moves through one complete revolution for every 180 crankcase pressure pulses (2° per pulse), or at 27.8 rpm (5000 pulses/min. divided by 180 pulses/rev.). Assume that the piston size, rocker arm dimensions, and wheel dimensions are such that a wheel speed of 27.8 rpm results in an oil flow rate such that the fuel/oil ratio is 50/1.

At idle, the wheel 38 will move through an arc of 1° for each crankcase pulse, since the pulse amplitude is ½ the pulse amplitude at WOT (assuming a linear function). Therefore, the wheel 38 will revolve once for every 360 pulses, or at 1.39 rpm (500 pulses/min. divided by 360 pulses/rev.). This wheel rpm at idle is 1/20th of the wheel rpm at WOT, and, therefore, the oil flow rate is equal to 1/20th of the oil flow rate at WOT. At the same time, the fuel flow rate at idle is 1/10th the fuel flow rate at WOT (this was assumed above). Therefore, because the fuel/oil ratio was 50/1 at WOT, and because, at idle, the fuel flow rate is only cut half as much as the oil flow rate, the fuel/oil ratio at idle is 100/1. Thus, the apparatus 10 provides a variable fuel to oil ratio.

If a greater ratio change between idle and WOT is desired, the stop 46 should be adjusted or extended to limit the return of the link 60 after each pulse. This will cause the stroke of the link 60, and therefore the rpm of the wheel 38, to vary more between idle and WOT, and this will result in a greater fuel to oil ratio change. For example, assume the link 60 moves 4 mm. at WOT and 2 mm. at idle. This is a ratio of 2/1. If the stop 46 is extended to cut one mm. from the return of the link 60, so that the link 60 moves 3 mm. at WOT and 1 mm. at idle, the ratio will be 3/1. Therefore, the ratio change between idle and WOT will be half again as great as before the stop 46 was adjusted.

Various features of the invention are set forth in the following claims.

I claim:

1. An engine apparatus comprising a two-cycle internal combustion engine including a crankcase that emits pressure pulses of variable amplitude and frequency, a lubricant reservoir, a pump having an inlet communicating with said reservoir and an outlet communicating with said engine, said pump including a reciprocating piston operable to pump lubricant from said reservoir to said engine at a flow rate that is a linear function of the frequency of reciprocation of said piston, a rotatable eccentric wheel including a cam surface, means engageable with said cam surface and communicating with said crankcase for rotating said wheel in response to said crankcase pressure pulses at an rpm that is a linear function of the pulse amplitude and of the pulse frequency, and means engageable with said cam surface for causing reciprocation of said piston in response to rotation of said wheel at a frequency that is a linear function of the rpm of said wheel.

2. An apparatus as set forth in claim 1 wherein said wheel is rotatable about a first pivot, and wherein said means for rotating said wheel includes a lever arm having a first end pivotally mounted on said first pivot, a pawl pivotally mounted on said lever arm and engageable with said cam surface for causing rotation of said wheel in one rotational direction in response to rotation of said lever arm in said one direction, and means for rotating said lever arm in said one direction in response to said crankcase pressure pulses.

3. An apparatus as set forth in claim 2 wherein said lever arm has a second end opposite said first end, wherein said means for rotating said lever arm includes a housing forming a recess, a moveable wall in said recess and defining a chamber in communication with said crankcase such that said wall moves in response to said crankcase pressure pulses, and a link connected between said moveable wall and said second end of said lever arm.

4. An apparatus as set forth in claim 2 and further comprising means for preventing rotation of said wheel in the rotational direction opposite of said one rotational direction.

5. An apparatus as set forth in claim 4 wherein said means for preventing rotation of said wheel in said opposite rotational direction includes a second pivot, a pawl pivotally mounted on said second pivot and engageable with said cam surface, and means biasing said pawl into engagement with said cam surface.

6. An apparatus as set forth in claim 1 wherein said means for causing reciprocation of said piston in response to rotation of said wheel includes a roller engageable with said cam surface, means biasing said roller into engagement with said cam surface, and linkage means connected between said piston and said roller for causing reciprocation of said piston in response to movement of said roller.

7. An apparatus as set forth in claim 6 wherein said linkage means includes a pivot, and a rocker arm pivotally mounted on said pivot and having a first end pivotally connected to said piston and a second end having said roller pivotally mounted thereon.

8. An apparatus as set forth in claim 6 wherein said pump includes a cylinder slidably receiving said piston and having a cylinder head, and wherein said means biasing said roller includes a spring positioned between said piston and said cylinder head and biasing said piston away from said cylinder head.

9. A mechanism for pumping fluid in response to pressure pulses, said mechanism comprising fluid pump means including a reciprocating piston operable to pump fluid, a rotatable eccentric wheel including a cam surface, means engageable with said cam surface for rotating said wheel in response to pressure pulses, and means engageable with said cam surface for causing reciprocation of said piston in response to rotation of said wheel.

10. A mechanism as set forth in claim 9 wherein said wheel is rotatable about a first pivot, and wherein said means for rotating said wheel includes a lever arm having a first end pivotally mounted on said first pivot, a pawl pivotally mounted on said lever arm and engageable with said cam surface for causing rotation of said wheel in one rotational direction in response to rotation of said lever arm in said one direction, and means for rotating said lever arm in said one direction in response to pressure pulses.

11. A mechanism as set forth in claim 10 wherein said lever arm has a second end opposite said first end, wherein said means for rotating said lever arm includes a housing forming a recess, a moveable wall in said recess and defining a chamber adapted to be in communication with a source of pressure pulses such that said wall moves in response to the pressure pulses, and a link connected between said moveable wall and said second end of said lever arm.

12. A mechanism as set forth in claim 10 and further comprising means for preventing rotation of said wheel in the rotational direction opposite of said one rotational direction.

13. A mechanism as set forth in claim 12 wherein said means for preventing rotation of said wheel in said opposite rotational direction includes a second pivot, a pawl pivotally mounted on said second pivot and engageable with said cam surface, and means biasing said pawl into engagement with said cam surface.

14. A mechanism as set forth in claim 9 wherein said means for causing reciprocation of said piston in response to rotation of said wheel includes a roller engageable with said cam surface, means biasing said roller into engagement with said cam surface, and linkage means connected between said piston and said roller for causing reciprocation of said piston in response to movement of said roller.

15. A mechanism as set forth in claim 14 wherein said linkage means includes a pivot, and a rocker arm pivotally mounted on said pivot and having a first end pivotally connected to said piston and a second end having said roller pivotally mounted thereon.

16. A mechanism as set forth in claim 14 wherein said fluid pump means includes a cylinder slidably receiving said piston and having a cylinder head, and wherein said means biasing said roller includes a spring positioned between said piston and said cylinder head and biasing said piston away from said cylinder head.

17. A mechanism for pumping fluid in response to pressure pulses having variable amplitude and frequency, said mechanism comprising fluid pump means including a reciprocating piston operable to pump fluid at a flow rate that is a linear function of the frequency of reciprocation of said piston, a rotatable eccentric wheel including a cam surface, means engageable with said cam surface for rotating said wheel in response to pressure pulses at an rpm that is a linear function of the pulse amplitude and of the pulse frequency, and means engageable with said cam surface for causing reciprocation of said piston in response to rotation of said wheel at a frequency that is a linear function of the rmp of said wheel.

18. A mechanism as set forth in claim 17 wherein said wheel is rotatable about a first pivot, and wherein said means for rotating said wheel includes a lever arm having a first end pivotally mounted on said first pivot, a pawl pivotally mounted on said lever arm and engageable with said cam surface for causing rotation of said wheel in one rotational direction in response to rotation of said lever arm in said one direction, and means for rotating said lever arm in said one direction in response to pressure pulses.

19. A mechanism as set forth in claim 18 wherein said lever arm has a second end opposite said first end, wherein said means for rotating said lever arm includes a housing forming a recess, a moveable wall in said recess and defining a chamber adapted to be in communication with a source of pressure pulses such that said wall moves in response to the pressure pulses, and a link connected between said moveable wall and said second end of said lever arm.

20. A mechanism as set forth in claim 18 and further comprising means for preventing rotation of said wheel in the rotational direction opposite of said one rotational direction.

21. A mechanism as set forth in claim 20 wherein said means for preventing rotation of said wheel in said opposite rotational direction includes a second pivot, a pawl pivotally mounted on said second pivot and engageable with said cam surface, and means biasing said pawl into engagement with said cam surface.

22. A mechanism as set forth in claim 17 wherein said means for causing reciprocation of said piston in response to rotation of said wheel includes a roller engageable with said cam surface, means biasing said roller into engagement with said cam surface, and linkage means connected between said piston and said roller for causing reciprocation of said piston in response to movement of said roller.

23. A mechanism as set forth in claim 22 wherein said linkage means includes a pivot, and a rocker arm pivotally mounted on said pivot and having a first end pivotally connected to said piston and a second end having said roller pivotally mounted thereon.

24. A mechanism as set forth in claim 22 wherein said fluid pump means includes a cylinder slidably receiving said piston and having a cylinder head, and wherein said means biasing said roller includes a spring positioned between said piston and said cylinder head and biasing said piston away from said cylinder head.

* * * * *